US008978939B2

(12) United States Patent
Bull et al.

(10) Patent No.: US 8,978,939 B2
(45) Date of Patent: Mar. 17, 2015

(54) VALVE RETAINING DEVICE

(75) Inventors: Martin C. Bull, Norfolk (GB); John Leamon, Norwick (GB)

(73) Assignee: Obrist Closures Switzerland GmbH, Reinach (CH)

( * ) Notice: Subject to any disclaimer, the term of this patent is extended or adjusted under 35 U.S.C. 154(b) by 931 days.

(21) Appl. No.: 11/573,715

(22) PCT Filed: Aug. 9, 2005

(86) PCT No.: PCT/EP2005/053917

§ 371 (c)(1),
(2), (4) Date: Feb. 15, 2007

(87) PCT Pub. No.: WO2006/021509

PCT Pub. Date: Mar. 2, 2006

(65) Prior Publication Data

US 2007/0295765 A1 Dec. 27, 2007

(30) Foreign Application Priority Data

Aug. 26, 2004 (EP) ..... 04255129

(51) Int. Cl.
*B65D 5/72* (2006.01)
*B65D 47/20* (2006.01)

(52) U.S. Cl.
CPC ..... *B65D 47/2031* (2013.01); *B65D 2547/066* (2013.01)
USPC ..... 222/494; 222/490

(58) Field of Classification Search
CPC ..... B65D 47/2031; B65D 47/2018; B65D 47/2081
USPC ..... 222/212, 490, 494; 29/509, 510
See application file for complete search history.

(56) References Cited

U.S. PATENT DOCUMENTS

| | | | | |
|---|---|---|---|---|
| 2,601,938 | A * | 7/1952 | Alexander | 222/5 |
| 3,618,825 | A * | 11/1971 | Clarke | 222/106 |
| 4,991,745 | A * | 2/1991 | Brown | 222/212 |
| 5,115,950 | A * | 5/1992 | Rohr | 222/490 |
| 5,632,420 | A * | 5/1997 | Lohrman et al. | 222/212 |
| 5,676,289 | A | 10/1997 | Gross et al. | |
| 5,743,443 | A | 4/1998 | Hins | |
| 5,788,108 | A | 8/1998 | Rohr | |
| 5,897,033 | A * | 4/1999 | Okawa et al. | 222/212 |
| 6,006,960 | A | 12/1999 | Gross | |
| 6,089,418 | A * | 7/2000 | Gaiser et al. | 222/494 |
| 6,405,901 | B1 * | 6/2002 | Schantz et al. | 222/213 |
| 6,543,652 | B1 * | 4/2003 | Kelder et al. | 222/212 |
| 6,948,643 | B1 * | 9/2005 | Lohrman | 222/556 |
| 7,152,763 | B2 * | 12/2006 | Stull et al. | 222/212 |
| 7,398,900 | B2 * | 7/2008 | Friedman | 222/494 |
| 7,861,393 | B2 * | 1/2011 | Pugne | 29/453 |

(Continued)

FOREIGN PATENT DOCUMENTS

| | | | |
|---|---|---|---|
| EP | 0 495 440 | | 7/1992 |
| GB | 2330577 | A * | 4/1999 |

(Continued)

*Primary Examiner* — Kevin P Shaver
*Assistant Examiner* — Robert Nichols, II
(74) *Attorney, Agent, or Firm* — Gifford, Krass, Sprinkle, Anderson & Citkowski, P.C.

(57) ABSTRACT

A retaining device (1) has a non-laminar self-closing valve (2) retained therein. The valve comprises a flange (8), and the rigidity of the flange (8) is increased by the device (1). The retaining device is a single-piece article.

10 Claims, 3 Drawing Sheets

(56) References Cited

U.S. PATENT DOCUMENTS

| | | | | |
|---|---|---|---|---|
| 8,397,957 | B2 * | 3/2013 | Bloom et al. | 222/494 |
| 8,640,928 | B2 * | 2/2014 | Ellenkamp-Van Olst et al. | 222/213 |
| 2006/0037975 | A1 * | 2/2006 | Suffa | 222/490 |

FOREIGN PATENT DOCUMENTS

| | | |
|---|---|---|
| JP | 10236498 | 9/1998 |
| WO | WO-2004/099024 | 11/2004 |
| WO | WO-2005/014418 | 2/2005 |

* cited by examiner

[Fig. 001]
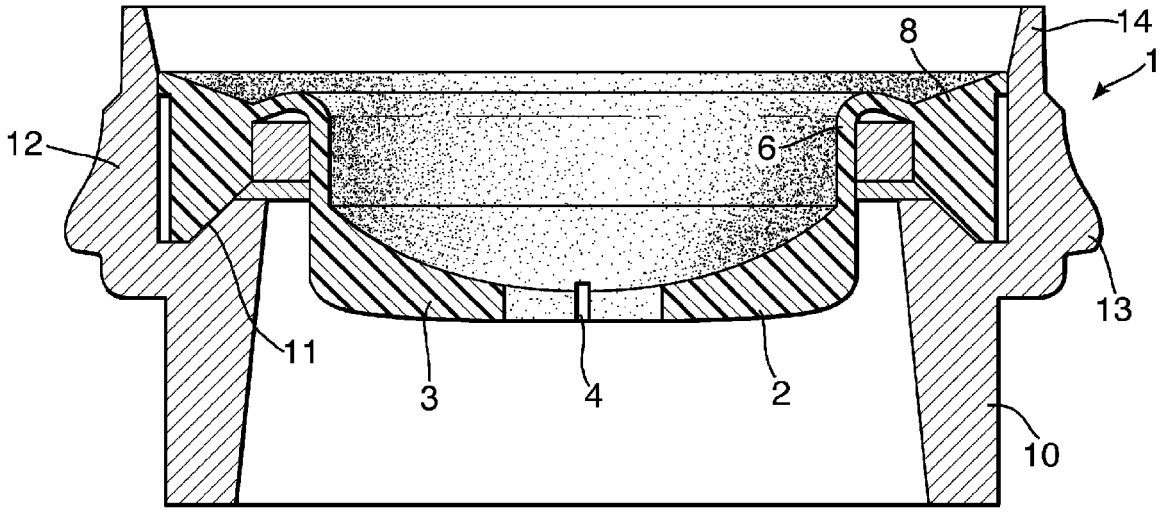
[Fig. 002]
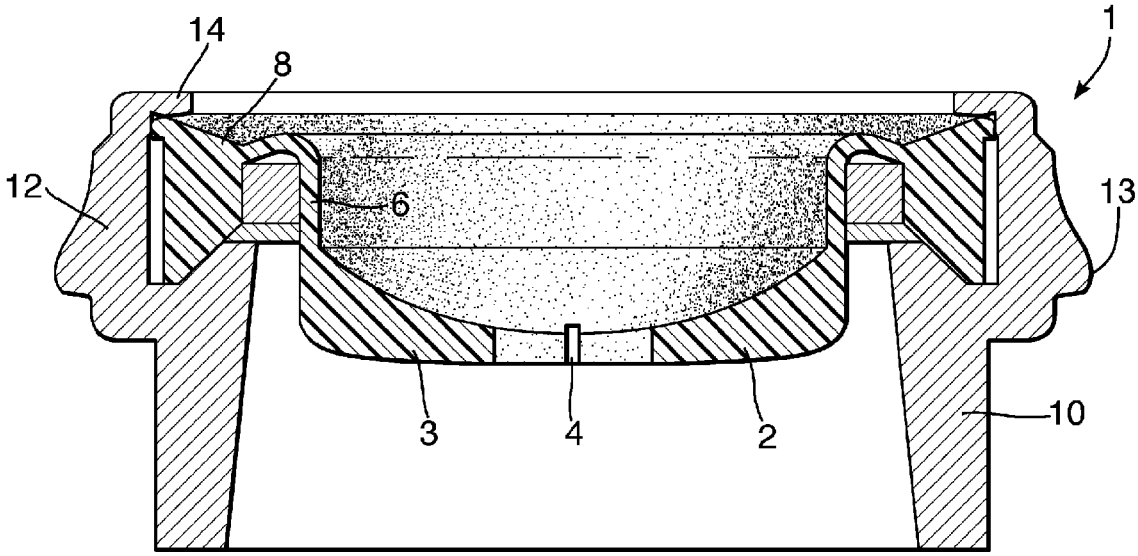

[Fig. 003]
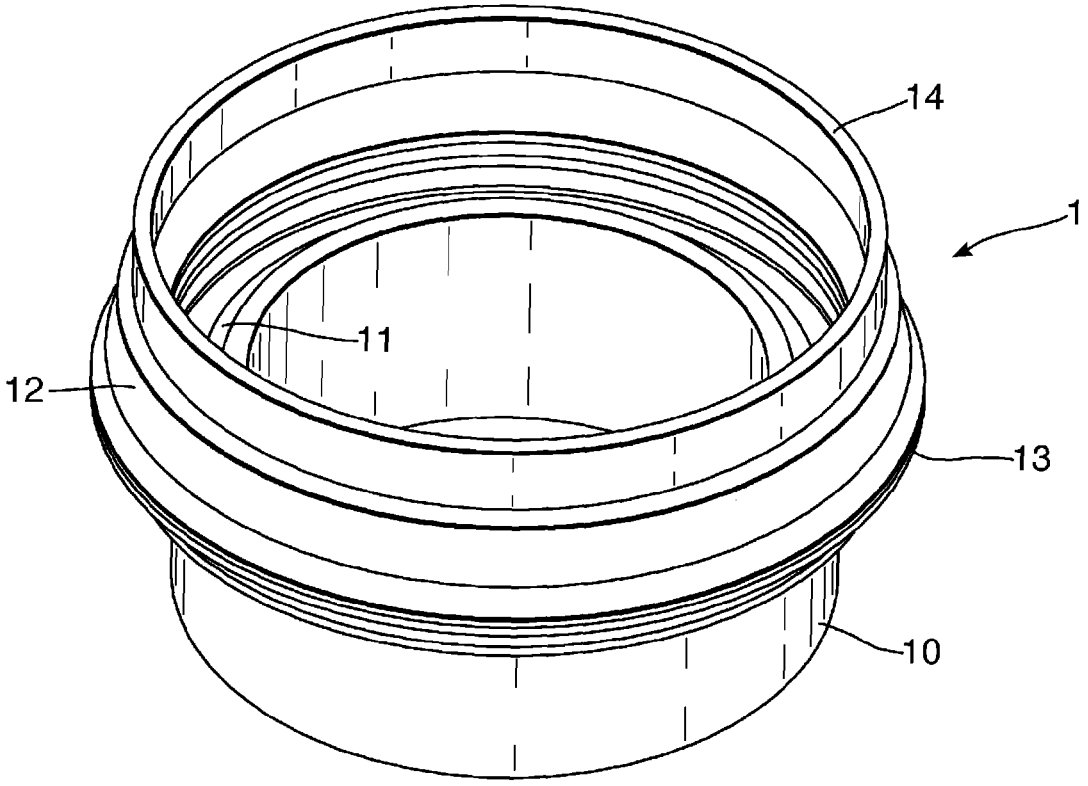
[Fig. 004]
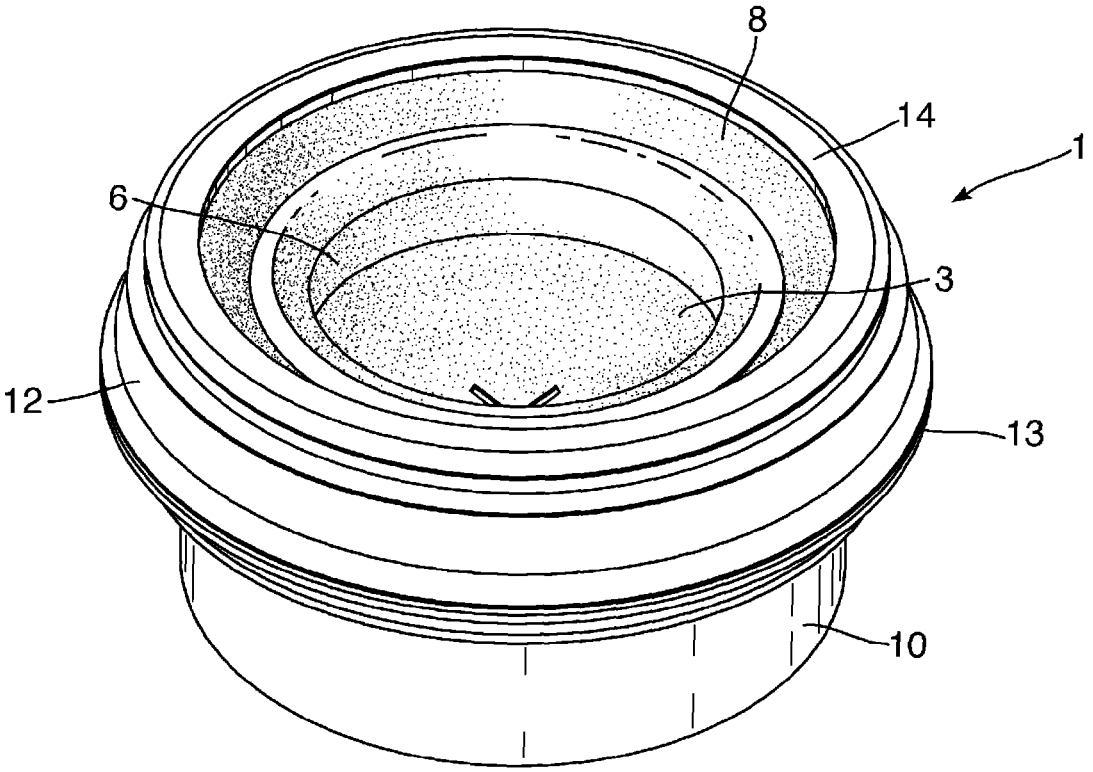

[Fig. 005]
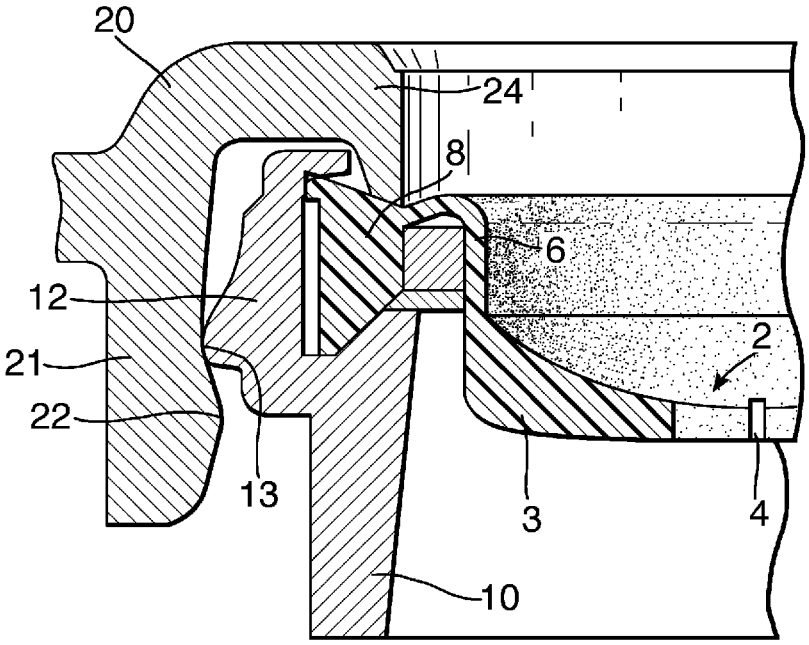

VALVE RETAINING DEVICE

The present invention relates to a device for retaining a flexible valve. This device may then be fitted into, and itself retained, within other articles such as closure devices.

Flexible valves come in many forms. For instance,
WO 2004026721—.
describes laminar-type flexible membrane valves, whereas
EP 0545678 B—.
and
EP 1005430 B—.
both describe silicon based flexible valves which are non-laminar in shape. The following description is related primarily to the latter form of non-laminar self-closing flexible valves. The construction of these types of valves may be generalised as comprising a concave or convex shaped head portion, with at least one slit, a side wall portion, and a flange.

In this application the term "laminar" relates to forms which have a substantially uniform thickness with major surfaces being parallel to one-another. The term "non-laminar" relates to forms which have a thickness which varies and in which the shape does not have major surfaces which are parallel to one-another.

These non-laminar valves are used in association with closures which are themselves used in association with containers holding such consumable products as liquid soap and ketchup. They have the quality that when a user applies pressure to the container walls (for example by squeezing) the head portion of the valve responds to this increased pressure within the container by opening outwards in the form of "petals". The fluid contained within the container then passes through the slit of the head portion of the valve. Further, the container walls are typically resilient such that when the user stops squeezing them they move back to their original shape thus increasing the volume within the container and accordingly reducing the pressure within the container. This reduced pressure sucks the open "petals" of the valve back to their original closed position. This self-closing property is aided by the concave shape of the valve head.

EP-B-0495440 describes how to retain these valves within closures by means of retaining pieces. Firstly, the valve is positioned within the closure at the relevant place and then a retaining piece is pushed over the valve until it snaps over a retaining bead within the closure. The valve is thus held captive between the closure and the retaining piece.

Another method of retaining such valves within closures is described in EP-B-1131252 where the valve is positioned within the closure and then a deformable ring forming part of the closure itself is bent over so that it crimps the valve in place. The valve is thus held captive against the closure by the crimped ring.

It should be stressed that neither of these methods of retention affects the shape of the valves to such an extent that the shape change impacts on the functioning of the valve.

Containers which are used for holding and dispensing food products, such as ketchup, often have peelable foil membranes affixed over the mouth of the container which has to be removed prior to the first dispensing. To remove this foil the user must first unscrew the closure from the container, then peel off the membrane, and then re-screw the closure back onto the container. Once this has been carried out the user may then squeeze the container and force the product through the valve and the associated spout or orifice situated in the closure, as discussed above.

It has been known however, for some users to merely push a pen or other such object through the orifice of the closure, which then passes through the valve and then through the foil membrane underneath to pierce this foil without the need to remove the closure from the container. Although, this may appear to save time, not only is hygiene a possible cause for concern, but more importantly it has been known for the pen or other such object to push out the valve from its crimped position, possibly by dislodging the retaining piece from the closure. The loose valve may then be dispensed with product when the container is squeezed since it is flexible enough to pass through the orifice. Further, because the valve may be covered in product it may be disguised and accordingly ingested by someone who was not aware it was there. Choking could result. The retaining piece however would not pass through the orifice since it is typically manufactured from harder material of a size which is greater than the size of the orifice.

Another problem that is known in relation to these type of flexible valves is that because they are so supple they are accordingly quite difficult to handle and position within the closure during assembly. This slows down the assembly of the closures. Further, the valves have a tendency to stick to each other and although talcum powder is used to reduce this problem it can also slow down assembly of closures.

It is the purpose of the present invention to overcome these problems of suppleness and flexibility so that it is impossible for valves which become loose within containers to pass through closure orifices, and also so that the handleability may be improved to increase the efficiency of the manufacture of closures.

In particular, it is an object of the present invention to provide a retaining device which is a single-piece article, and which is adapted to retain therein a non-laminar self-closing valve. This is in contrast to prior art arrangements in which the valve is not retained within the retaining device but is merely held between the retaining device and another element such as a part of a closure. The arrangement of the invention has the advantage that the valve can be fitted fixedly into the retaining device for handling and/or transportation prior to assembly of the valve and retaining device combination into a closure. Further, since the valve is fixed into the retaining means, it cannot be separated therefrom and inadvertently dispensed through the closure.

In one aspect the invention provides a retaining device comprising a non-laminar self-closing valve retained therein, wherein said valve comprises a flange, and the rigidity of said flange is increased by said device; characterised in that the retaining device is a single-piece article.

Further embodiments are disclosed in the dependent claims attached hereto.

The present invention and its advantages will be better understood by referring, by way of example, to the following detailed description and the attached Figures, in which;

FIG. 1 shows a cross-section through the device with a valve loosely in position.

FIG. 2 shows a cross-section through the device with a valve crimped in position.

FIG. 3 shows a perspective view of the device without a valve in position.

FIG. 4 shows a perspective view of the device with a valve crimped in position.

FIG. 5 shows a cross-section of one half of the device with a valve crimped into position and with the device positioned in a closure.

In the following description, all orientational terms, such as upper, lower, radially and axially, are used in relation to the cross-sectional drawings shown in FIGS. 1, 2 and 5 and should not be interpreted as limiting on the invention or its connection to a closure.

Referring to FIG. 1, the device 1, which shall be referred to hereinafter as a retaining ring 1, consists of a moulded single-piece article with a so-called "chimney" in the form of a circular wall 10. This chimney 10 provides a surface for assembly machinery to handle the retaining ring 1. At one end of the chimney 10 is a radially outwardly sloping surface 11. At the outer radial end of this sloping surface 11 another circular wall 12, which has the same rotational axis as chimney 10, extends upwards.

Along the circumference of the radially outer surface of wall 12 is a projection in the form of an external sealing bead 13. At the end of wall 12 is a crimping flange 14 which in its uncrimped condition is a relatively short upstanding wall.

A flexible self-closing valve 2 typically has the features shown in FIG. 1. For instance, such a valve 2 has a head portion 3, which is thicker towards the edge than the centre and which has at least one slit 4 therein. The head portion is concave with respect to a container (not shown). This pre-stresses the valve so that it self-closes more easily.

A side-wall portion 6 connects the head portion 3 with a flange 8. Flange 8 is typically shaped such that it has a relatively substantial size in the form of a rim. It is this flange 8 which rests on the sloping surface 11 of the retaining ring 1 when it is located correctly.

To crimp the valve in place, the crimping flange 14 is bent over until it sandwiches the flange 8 between itself 14 and the sloping surface 11.

FIG. 2 shows a valve 2 with the crimping flange 14 bent over. Although the crimping flange 14 is shown as being bent over by 90 degrees radially inwards it should be understood that the angle through which it need be bent is not fixed. For instance, it has been found that the crimping flange 14 need only be bent over by a few degrees in order that it hold the valve 2 in place within the retaining ring 1. This is because the crimping flange 14 is bent over along the entire circumference of the retaining ring 1 and valve 2. Further, the crimping flange 14 could be bent over by more than 90 degrees so that it lies against and substantially parallel with the surface of flange 8.

FIGS. 3 and 4 show perspective views of the retaining ring 1. In FIG. 3, no valve is present and the crimping flange 14 is upstanding and not bent over. In FIG. 4, a valve 2 is present and the crimping flange 14 has been bent over the valve's flange 8. Other referenced parts are numbered in accordance with FIGS. 1 and 2 and shall therefore not be described in detail.

FIG. 5 only depicts one half of the structure which is to be described below. This is because the structure is symmetrical and is identical on both sides.

A retaining ring 1 is shown with a valve 2 crimped in place. Further, the retaining ring 1 is positioned within a closure 20. The closure 20 has a circular wall 21 which has a rotational axis coincident with the axis of the retaining ring 1. Along the radially inner side of this wall 21 is a sealing bead 22 in the form of a projection.

At the upper end of wall 21 is another wall 24 which lies perpendicular to wall 21. This wall 24 extends radially inward from wall 21.

When the retaining ring 1 is fitted to the closure 20 it is pushed into the closure until the crimping flange 14 meets with the underside of wall 24. Further, sealing bead 13, on the radially outer side of wall 12 of the retaining ring 1, is provided such that it has an external diameter greater than that of the diameter of radially inner surface of sealing bead 22. Accordingly, the retaining ring 1 snap-fits into the closure 20 so that the two sealing beads 13,22 form an interference seal in a manner well known in the art.

Alternative methods of fitting the retaining ring 1 in the closure 20 are of course possible. Such methods could include gluing, corresponding screw threads and chemical means.

Further, although the valve 2 has been shown to be crimped into the retaining ring 1, it would of course be possible to glue or affix the valve 2 to the retaining ring 1 by other means such as by chemical means.

Further still, it has been found that contrary to expectation it has been possible to bend over the crimping flange 14 without the need to apply heat to soften the material.

Yet further, although only one valve 2 has been discussed it would be possible to design a retaining ring 1 which could have more than one valve 2 crimped into it. This might be useful if it was desired to have a closure with more than one dispensing orifice.

Although the advantages of the above described retaining ring have already been discussed, (improved rigidity to improve handleability and prevent accidental passing of the valve 2 through an orifice of a closure), further advantages may be gained. One such advantage is that the valve and retaining ring may be pre-assembled on a different production machine than the machines which are used to produce the closures or assemble the closures, if different therefrom. Further, because the valves and retaining ring can be assembled more quickly than the closure can be produced or assembled, a stock of these pre-assembled valves and retaining rings can be maintained, with obvious benefits.

Another advantage of the invention is that the rigidity of the flange of the valve is increased by means of a single-piece article. This is different to the known art in which it is necessary to use two separate articles, the retaining ring and the closure, to retain the valve.

The invention claimed is:

1. A retainer device for retaining a non-laminar, flange-presenting self-closing valve in a closure for a container in which the closure is adapted for direct connection with the container, the device being separate from the closure for the container and separate from the container, the device having a crimping flange movable from an uncrimped position to a crimped position for engaging the said valve flange and sandwiching said valve flange between said crimping flange and a surface on the device to retain the valve in the device, the crimping flange being separate from the closure for the container and separate from the container, so that the device is fitted into said closure for the container in a single configuration which permits dispensing.

2. A device according to claim 1, in which the crimping flange comprises an upstanding wall.

3. A device according to claim 1, in which the device comprises a circular upstanding wall and the crimping flange comprises a circumferentially upstanding wall.

4. A device according to claim 1, in which the device comprises a bead for snap-fitting the device into a closure.

5. A device according to claim 1, in which the device comprises a sloping surface for receiving the valve flange.

6. A device according to claim 1, in which the device is formed as a retaining ring.

7. A device according to claim 1, in which the device is formed as a single-piece article.

8. In combination with a container, a retainer device for retaining a non-laminar, flange-presenting self-closing valve in a closure for the container in which the closure is configured for direct connection with the container, the device being separate from the closure for the container and separate from the container, the device having a crimping flange movable from an uncrimped position to a crimped position for engaging the said valve flange and sandwiching said valve flange between said crimping flange and a surface on the device to retain the valve in the device, the crimping flange being separate from the closure for the container and separate from the container, so that the device is fitted into said closure for the container in a single configuration which permits dispensing.

9. A combination as claimed in claim 8, in which the device is snap-fitted into the closure.

10. A combination as claimed in claim 8, in which the device and the closure include co-operating sealing beads for fixing the device into the closure.

* * * * *